US012203256B1

(12) United States Patent
Zheng

(10) Patent No.: US 12,203,256 B1
(45) Date of Patent: Jan. 21, 2025

(54) SINK BASIN SUPPORT STRUCTURE

(71) Applicant: Enping Mansheng Trading Co., Ltd., Enping (CN)

(72) Inventor: Renjie Zheng, Enping (CN)

(73) Assignee: Enping Mansheng Trading Co., Ltd., Enping (CN)

( * ) Notice: Subject to any disclaimer, the term of this patent is extended or adjusted under 35 U.S.C. 154(b) by 0 days.

(21) Appl. No.: 18/882,204

(22) Filed: Sep. 11, 2024

(30) Foreign Application Priority Data

Jan. 23, 2024 (CN) ..... 202420171073.6

(51) Int. Cl.
*E03C 1/33* (2006.01)

(52) U.S. Cl.
CPC ..... *E03C 1/33* (2013.01)

(58) Field of Classification Search
CPC ..... E03C 1/33
See application file for complete search history.

(56) References Cited

U.S. PATENT DOCUMENTS 5,538,206 A * 7/1996 Sather ..... E03C 1/33 4/643
7,698,753 B2 * 4/2010 Jones ..... E03C 1/32 4/643
8,070,110 B2 * 12/2011 Jones ..... E03C 1/33 248/200.1

* cited by examiner

*Primary Examiner* — Christine J Skubinna
(74) *Attorney, Agent, or Firm* — Daylight Law, P.C.

(57) ABSTRACT

A sink basin support structure includes: at least two support rods parallel to each other, where brackets are disposed at both ends of each of the support rods; each of the support rods is provided with a fixed rod and movable rods movably connected to both sides of the fixed rod; each of the movable rods is provided with a chute, the fixed rod is provided with screw holes, and each of the movable rods is fixed on the fixed rod by a fixing bolt inserted into the respective chute and the respective screw hole; each of the brackets is provided with a support block and a fixing block, and the support block and the fixing block are fixedly connected through a connecting block.

10 Claims, 4 Drawing Sheets

SINK BASIN SUPPORT STRUCTURE

CROSS-REFERENCE TO RELATED APPLICATION

This application is based on and claims the benefit of priority from Chinese Patent Application No. 202420171073.6, filed on 23 Jan. 2024, the entirety of which is incorporated by reference herein.

TECHNICAL FIELD

The present disclosure relates to the technical field of home decoration and sanitary equipment, and in particular, to a sink basin support structure.

BACKGROUND

At present, most sink basins used in kitchens and bathrooms include a countertop and a basin. A receiving tank that can accommodate the basin is provided in the countertop, and the bottom surface of the basin is directly adhered to the bottom of the receiving tank of the countertop. In order to increase the stability of the basin, an under-counter basin bracket is usually provided on the bottom of the basin. To accommodate basins of different sizes, under-counter basin brackets with adjustable sizes have been developed. However, the existing under-counter basin brackets with adjustable sizes have a limited adjustment range, which affects the compatibility of the sink basin brackets. In addition, the structure is complex and the support hardness is poor, which brings inconvenience to the installation of the sink basins.

SUMMARY

In order to solve the above problems, the purpose of the present disclosure is to provide a sink basin support structure.

The technical solution adopted by the present disclosure to solve its problems is as follows.

A sink basin support structure is provided, including: at least two support rods parallel to each other, wherein brackets are disposed at both ends of each of the support rods; each of the support rods is provided with a fixed rod and movable rods movably connected to both sides of the fixed rod; each of the movable rods is provided with a chute, the fixed rod is provided with screw holes, and each of the movable rods is fixed on the fixed rod by a fixing bolt inserted into the respective chute and the respective screw hole; each of the brackets is provided with a support block and a fixing block, and the support block and the fixing block are fixedly connected through a connecting block; the support block is provided with a positioning groove that matches the respective movable rod, the connecting block is provided with an adjusting bolt for adjusting a height of the respective support rod, and the fixing block is provided with through holes for fixing the respective bracket.

The above sink basin support structure has at least the following beneficial effects. By providing the support rods and the brackets, parallel support rods can stably support the sink basin through the brackets, and both ends of the support rods are fixed by means of the through holes, improving the stability of the sink basin support structure. By providing the fixed rods, the movable rods, and the fixing bolts, the length of the support rods can be flexibly adjusted to adapt to different installation environments by changing the positions of the fixed rods relative to the respective movable rods and tightening the fixing bolts for fixation, improving the compatibility of the sink basin support structure. By providing the support blocks and the connecting blocks, the movable rods can be stably fixed in the respective positioning grooves, and the height can be adjusted through the adjusting bolts, improving the installation convenience and stability of the sink basin support structure.

Further, a buffer portion is disposed at an end of each of the movable rods away from the fixed rod. By providing the buffer portions, both ends of the support rods are prevented from causing damage to a wall during the installation process, and the support rods are prevented from loosening and affecting the stability of the sink basin, improving the installation stability of the sink basin support structure.

Further, the buffer portion is made of rubber. Rubber has good elasticity and wear resistance, and the buffer portion made of rubber improves the stability and prolongs the service life of the sink basin support structure.

Further, planes on which the support block and the fixing block are located are both perpendicular to a plane on which the connecting block is located. This structure ensures the structural stability of the bracket, the support block can stably support the respective movable rod, and the fixing block can be stably fixed on the wall, preventing the respective support rod from loosening.

Further, a length direction of the adjusting bolt is consistent with an opening direction of the positioning groove. This structure ensures that the adjusting bolt can accurately and smoothly raise the respective movable rod clamped in the positioning groove, improving the installation convenience of the sink basin support structure.

Further, the through holes are evenly distributed on the fixing blocks. This structure ensures that the fixing blocks can be stably fixed on the wall, preventing a condition that the stability of the sink basin support structure is affected as the bracket is loosened and rotated.

Further, the chute is located on both sides of the movable rod, and the fixing bolt is locked with a nut by passing through the respective chute and the respective screw hole. By providing the nut, the connection stability between the fixed rod and the movable rod is ensured, preventing the fixing bolt from loosening with the chut and the screw hole, which could adversely affect the integrity of the support rod.

Further, two screw holes are provided, which corresponding to two movable rods respectively, allowing adjustment of both ends of the fixed rod with respect to the movable rods according to installation environments, expanding the adjustment range of the support rod and ensuring the compatibility of the sink basin support structure.

Further, the support rods and the brackets are both made of stainless steel. Stainless steel has the advantages such as good corrosion resistance, high strength, and easy cleaning. The support rods and brackets both made of stainless steel ensure the structural stability and the service life of the sink basin support structure.

Further, the fixing bolt and the adjusting bolt are both hexagonal bolts. Hexagonal bolts have the advantages of good self-pinching and large pre-tightened contact area. The fixing bolts and the adjusting bolts being both hexagonal bolts can effectively prevent the support rods and brackets from loosening during use and ensure the structural stability of the sink basin support structure.

The beneficial effects of the above sink basin support structure are as follows. By providing the support rods and the brackets, parallel support rods can stably support the sink basin through the brackets, and both ends of the support rods are fixed by means of the through holes, improving the stability of the sink basin support structure. By providing the fixed rods, the movable rods, and the fixing bolts, the length of the support rods can be flexibly adjusted to adapt to different installation environments by changing the positions of the fixed rods relative to the respective movable rods and tightening the fixing bolts for fixation, improving the compatibility of the sink basin support structure. By providing the support blocks and the connecting blocks, the movable rods can be stably fixed in the respective positioning grooves, and the height can be adjusted through the adjusting bolts, improving the installation convenience and stability of the sink basin support structure. By providing the buffer portions, both ends of the support rods are prevented from causing damage to the wall during the installation process, and the support rods are prevented from loosening to affect the stability of the sink basin, improving the installation stability of the sink basin support structure.

Additional aspects and advantages of the present disclosure will be set forth in part in the description which follows, and in part will be obvious from the description, or may be learned by practice of the present disclosure.

DETAILED DESCRIPTION

Figure 1:
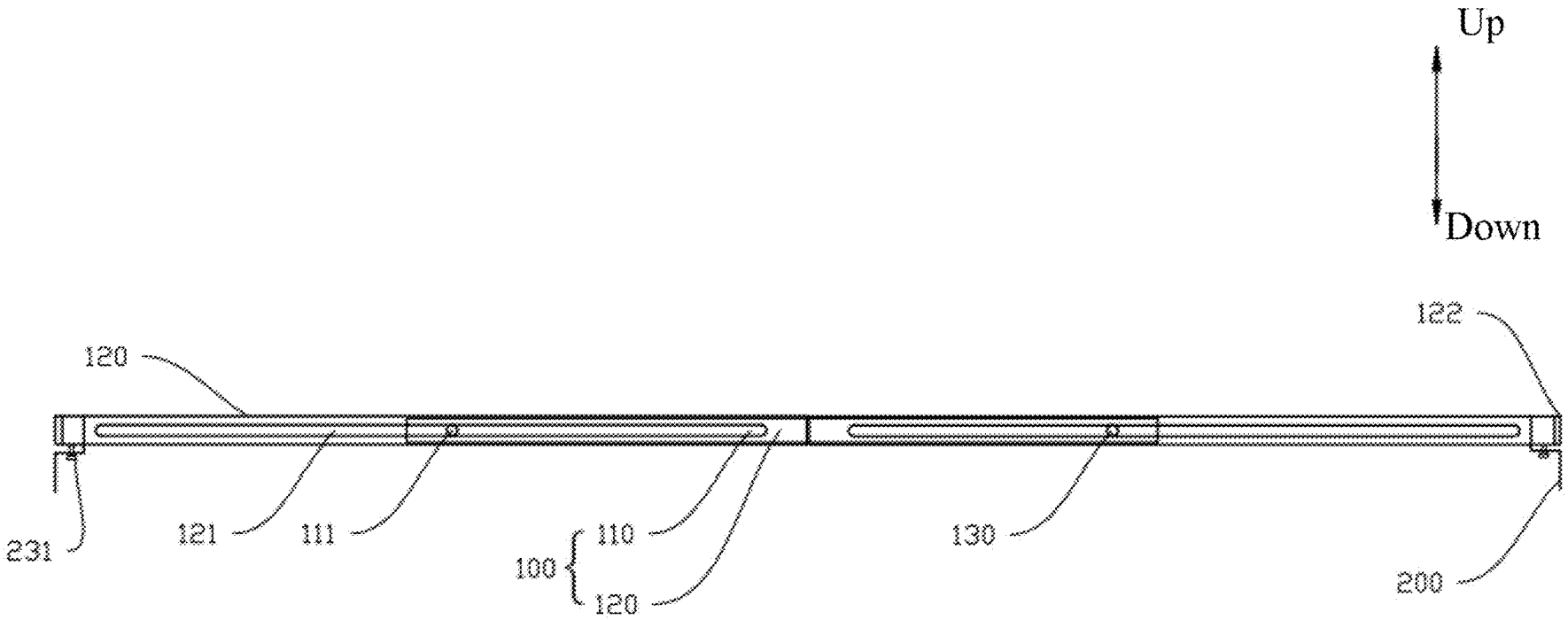
FIG. 1 is a schematic structural diagram of a sink basin support structure according to an embodiment of the present disclosure.

The embodiments of the present disclosure are described in detail below. Examples of the embodiments are shown in the accompanying drawings, in which the same or similar reference numerals throughout represent the same or similar elements or elements with the same or similar functions. The embodiments described below with reference to the accompanying drawings are exemplary and are merely used to explain the present disclosure and cannot be understood as limitations of the present disclosure.

Figure 2:
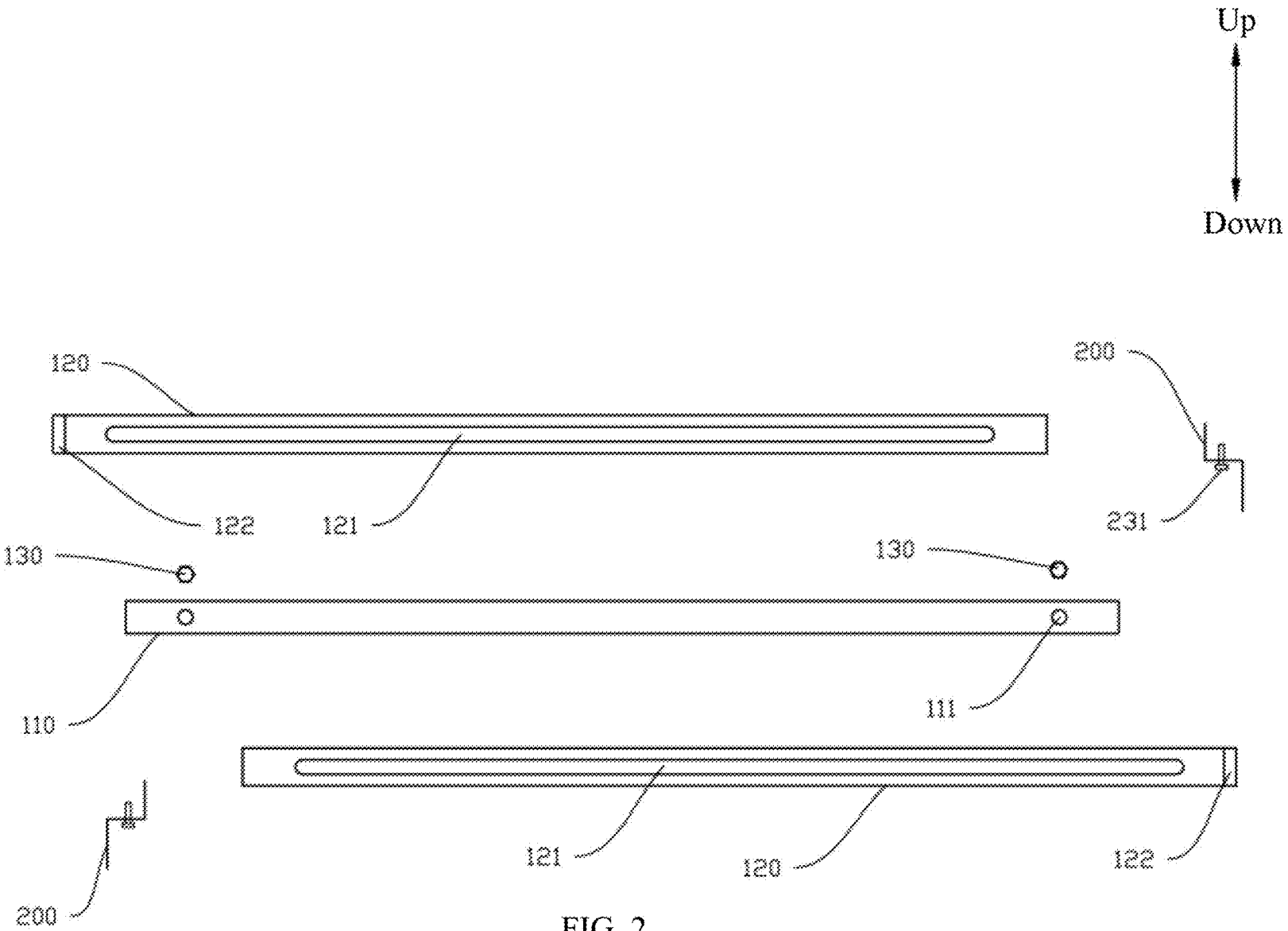
FIG. 2 is an exploded structural view of a sink basin support structure according to an embodiment of the present disclosure.
Figure 3:
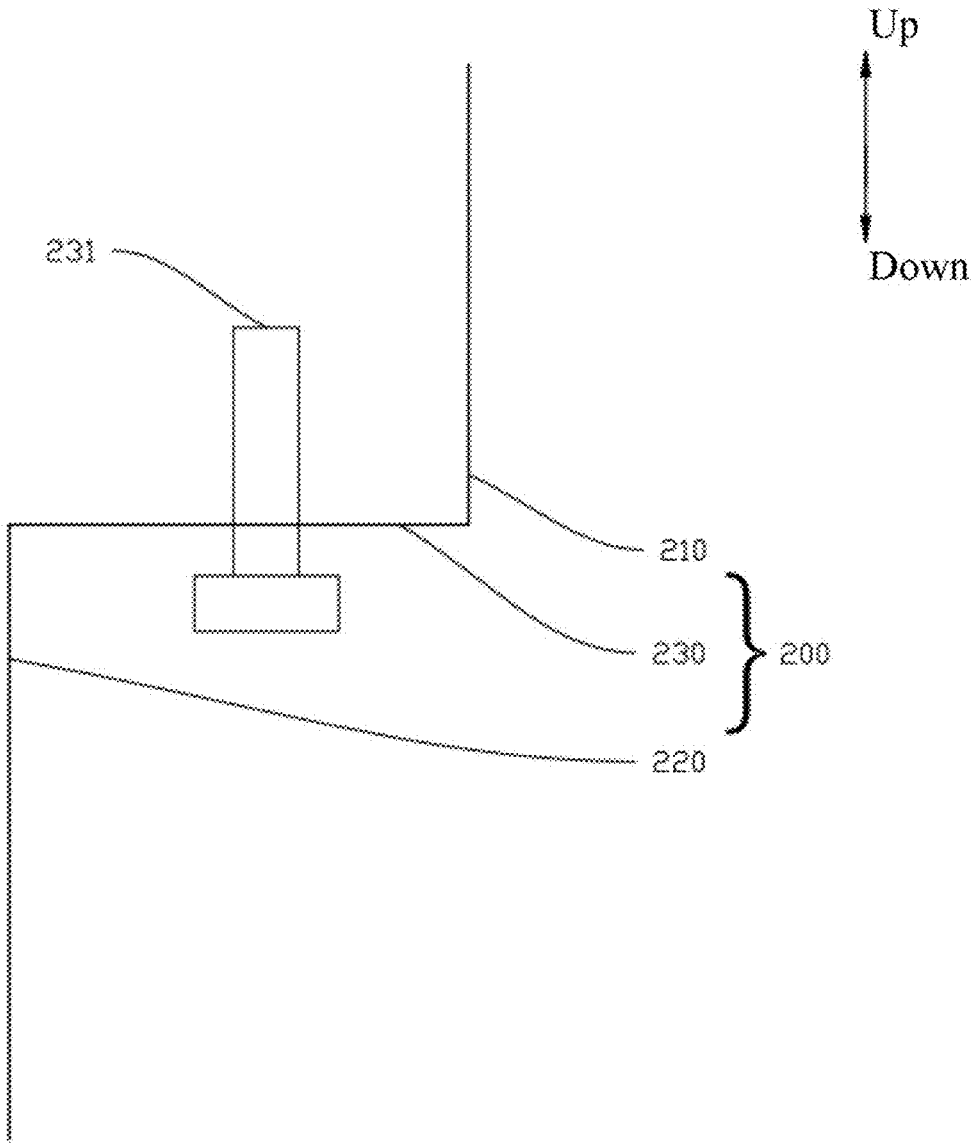
FIG. 3 is an enlarged structural view of a bracket in FIG. 1.
Figure 4:
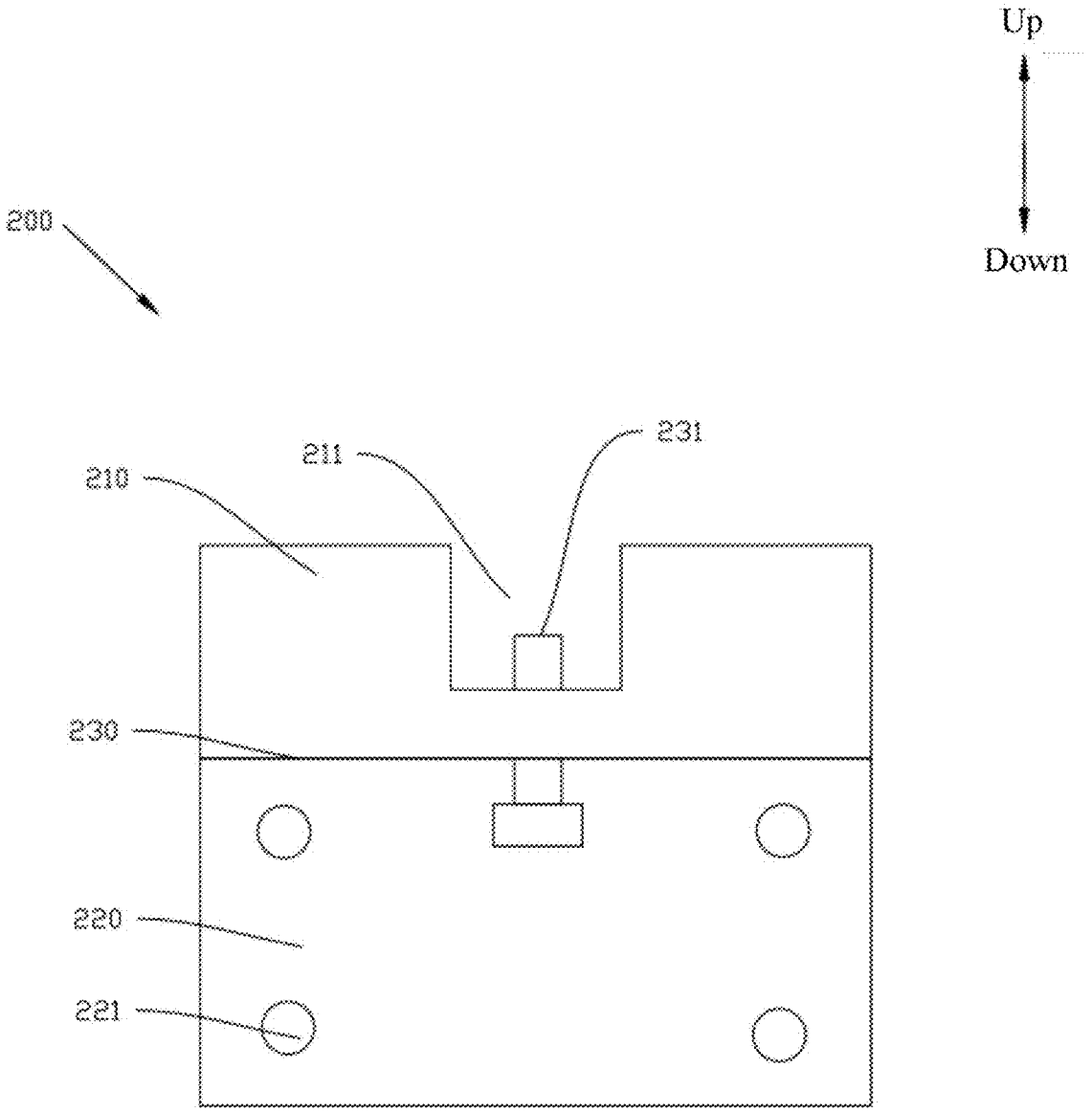
FIG. 4 is a side view of the bracket in FIG. 1.

Referring to FIGS. 1 to 4, an embodiment of the present disclosure provides a sink basin support structure, including: at least two support rods 100 parallel to each other. Brackets 200 are disposed at both ends of each of the support rods 100. Each of the support rods 100 is provided with a fixed rod 110 and movable rods 120 movably connected to both sides of the fixed rod 110. Each of the movable rods 120 is provided with a chute 121, the fixed rod 110 is provided with screw holes 111, and the movable rods 120 are fixed on the fixed rod 110 by respective fixing bolts 130 inserted into the chutes 121 and the screw holes 111. Each of the brackets 200 is provided with a support block 210 and a fixing block 220, and the support block 210 and the fixing block 220 are fixedly connected through a connecting block 230. The support block 210 is provided with a positioning groove 211 that matches the respective movable rod 120, the connecting block 230 is provided with an adjusting bolt 231 for adjusting a height of the respective support rod 100, and the fixing block 220 is provided with through holes 221 for fixing the respective bracket 200.

By providing the support rods 100 and the brackets 200, parallel support rods 100 can stably support the sink basin through the brackets 200, and both ends of the support rods 100 are fixed by means of the through holes 221, improving the stability of the sink basin support structure. By providing the fixed rods 110, the movable rods 120, and the fixing bolts 130, the length of the support rods 100 can be flexibly adjusted to adapt to different installation environments by changing the positions of the fixed rods 110 relative to the respective movable rods 120 and tightening the fixing bolts 130 for fixation, improving the compatibility of the sink basin support structure. By providing the support blocks 210 and the connecting blocks 230, the movable rods 120 can be stably fixed in the respective positioning grooves 211, and the height can be adjusted through the adjusting bolts 231, improving the installation convenience and stability of the sink basin support structure.

In another embodiment, a buffer portion 122 is disposed at an end of each of the movable rods 120 away from the fixed rod 110. By providing the buffer portions 122, both ends of the support rods 100 are prevented from causing damage to the wall during the installation process, and the support rods 100 are prevented from loosening to affect the stability of the sink basin, improving the installation stability of the sink basin support structure.

In another embodiment, the buffer portion 122 is made of rubber. Rubber has good elasticity and wear resistance, and the buffer portion 122 made of rubber improves the stability and prolongs the service life of the sink basin support structure.

In another embodiment, planes on which the support block 210 and the fixing block 220 are located are both perpendicular to a plane on which the connecting block 230 is located. This structure ensures the structural stability of the bracket 200, the support block 210 can stably support the respective movable rod 120, and the fixing block 220 can be stably fixed on the wall, preventing the respective support rod 100 from loosening.

In another embodiment, a length direction of the adjusting bolt 231 is consistent with an opening direction of the positioning groove 211. This structure ensures that the adjusting bolt 231 can accurately and smoothly raise the respective movable rod 120 clamped in the positioning groove 211, improving the installation convenience of the sink basin support structure.

In another embodiment, the through holes 221 are evenly distributed on the fixing block 220. This structure ensures that the fixing block 220 can be stably fixed on the wall, preventing a condition that the stability of the sink basin support structure is affected as the bracket 200 is loosened and rotated.

In another embodiment, the chute 121 is located on both sides of the movable rod 120, and each of the fixing bolts 130 is locked with a nut by passing through the respective chute 121 and the respective screw hole 111. By providing the nut, the connection stability between the fixed rod 110 and the movable rod 120 is ensured, preventing the fixing bolt from loosening with the chut and the screw hole, which could adversely affect the integrity of the support rod 100.

In another embodiment, two screw holes 111 are provided, which correspond to two movable rods 120 respectively, allowing adjustment of both ends of the fixed rod 110 with respect to the movable rods 120 according to installation environments, expanding the adjustment range of the support rod 100 and ensuring the compatibility of the sink basin support structure.

In another embodiment, the support rods 100 and the brackets 200 are both made of stainless steel. Stainless steel has the advantages such as good corrosion resistance, high strength, and easy cleaning. The support rods 100 and brackets 200 both made of stainless steel ensure the structural stability and service life of the sink basin support structure.

In another embodiment, the fixing bolts 130 and the adjusting bolts 231 are both hexagonal bolts. Hexagonal bolts have the advantages of good self-pinching and large pre-tightened contact area. The fixing bolts 130 and the adjusting bolts 231 being both hexagonal bolts can effectively prevent the support rods 100 and brackets 200 from loosening during use and ensure the structural stability of the sink basin support structure.

The working principle of the present disclosure will be further explained below.

During the installation process, the installation positions of the brackets 200 are first determined based on the height of the sink basin and the height of the countertop, so that the support rods 100 can support the sink basin to be level with the upper surface of the countertop. Then, the fixing blocks of the brackets 200 at both sides are attached fixedly to the respective walls by means of the bolts inserted into the respective through holes 211. Since the through holes 221 are evenly distributed on the fixing blocks 220, it ensures that the fixing blocks 220 can be stably fixed on the walls, preventing the brackets 200 from loosening and rotating. Next, the movable rods 120 slide on both sides of the fixed rod 110 so that the length of each of the support rods 100 is equal to the distance between the brackets 200. The brackets 200 are inserted into the respective positioning grooves 211, and the buffer portions 122 on the movable rods 120 abut respectively against the walls. Then, the fixing bolts 130 are locked with the nuts by passing through the respective chutes 121 and the respective screw holes 111, and the movable rods 120 on both sides are fixed on the fixed rod 110. Next, the sink basin is placed on two parallel support rods 100, so that the support rods 100 support the sink basin stably. At this time, if the upper surface of the sink basin cannot fit the lower end of the countertop, the adjusting bolts 231 are rotated to drive the movable rods 120 to move up and down, so as to adjust the position of the sink basin in the vertical direction, ensuring that the upper surface of the sink basin can fit the lower end of the countertop precisely. The entire installation process is fast and the positioning is precise. The support rods 100 can adapt to countertops of different widths, and the brackets 200 can stably support the movable rods 120 to prevent the sink basin from loosening during installation and use and ensure the compatibility and ease of installation of the sink basin support structure.

It can be seen from the above description that in the sink basin support structure of the present disclosure, by providing the support rods 100 and the brackets 200, parallel support rods 100 can stably support the sink basin through the brackets 200, and both ends of the support rods 100 are fixed by means of the through holes 221, improving the stability of the sink basin support structure. By providing the fixed rods 110, the movable rods 120, and the fixing bolts 130, the length of the support rods 100 can be flexibly adjusted to adapt to different installation environments by changing the positions of the fixed rods 110 relative to the respective movable rods 120 and tightening the fixing bolts 130 for fixation, improving the compatibility of the sink basin support structure. By providing the support blocks 210 and the connecting blocks 230, the movable rods 120 can be stably fixed in the respective positioning grooves 211, and the height can be adjusted through the adjusting bolts 231, improving the installation convenience and stability of the sink basin support structure. By providing the buffer portions 122, both ends of the support rods 100 are prevented from causing damage to the wall during the installation process, and the support rods 100 are prevented from loosening to affect the stability of the sink basin, improving the installation stability of the sink basin support structure.

The embodiments of the present disclosure are described in detail above in conjunction with the accompanying drawings. However, the present disclosure is not limited to the above embodiments. Within the scope of knowledge possessed by those of ordinary skill in the art, various changes can be made without departing from the purpose of the present disclosure.

What is claimed is:

1. A sink basin support structure, comprising: at least two support rods parallel to each other, wherein brackets are disposed at both ends of each of the support rods; each of the support rods is provided with a fixed rod and movable rods movably connected to both sides of the fixed rod; each of the movable rods is provided with a chute, the fixed rod is provided with screw holes, and each of the movable rods is fixed on the fixed rod by a fixing bolt inserted into the respective chute and the respective screw hole; each of the brackets is provided with a support block and a fixing block, and the support block and the fixing block are fixedly connected through a connecting block; the support block is provided with a positioning groove that matches the respective movable rod, the connecting block is provided with an adjusting bolt for adjusting a height of the respective support rod, and the fixing block is provided with through holes for fixing the respective bracket.

2. The sink basin support structure according to claim 1, wherein a buffer portion is disposed at an end of each of the movable rods away from the fixed rod.

3. The sink basin support structure according to claim 2, wherein the buffer portion is made of rubber.

4. The sink basin support structure according to claim 1, wherein planes on which the support block and the fixing block are located are both perpendicular to a plane on which the connecting block is located.

5. The sink basin support structure according to claim 4, wherein a length direction of the adjusting bolt is consistent with an opening direction of the positioning groove.

6. The sink basin support structure according to claim 4, wherein the through holes are evenly distributed on the fixing block.

7. The sink basin support structure according to claim 1, wherein the chute is located on both sides of the respective movable rod, and the fixing bolt is locked with a nut by passing through the chute and the screw hole.

8. The sink basin support structure according to claim 7, wherein the through holes comprises two screw holes.

9. The sink basin support structure according to claim 1, wherein the support rods and the brackets are both made of stainless steel.

10. The sink basin support structure according to claim 1, wherein the fixing bolt and the adjusting bolt are both hexagonal bolts.

* * * * *